US009724945B2

(12) United States Patent
Okuda

(10) Patent No.: US 9,724,945 B2
(45) **Date of Patent: *Aug. 8, 2017**

(54) PRINTER AND CONTROL METHOD FOR A PRINTER

(71) Applicant: Seiko Epson Corporation, Tokyo (JP)

(72) Inventor: Yasumichi Okuda, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 15/188,379

(22) Filed: Jun. 21, 2016

(65) Prior Publication Data

US 2016/0297220 A1 Oct. 13, 2016

Related U.S. Application Data

(63) Continuation of application No. 14/590,200, filed on Jan. 6, 2015, now Pat. No. 9,393,821.

(30) Foreign Application Priority Data

Jan. 17, 2014 (JP) ..... 2014-006461

(51) Int. Cl.

| | |
|---|---|
| ***B41J 25/308*** | (2006.01) |
| ***B41J 15/04*** | (2006.01) |
| ***B41J 25/304*** | (2006.01) |
| ***B41J 29/393*** | (2006.01) |
| ***B41J 2/155*** | (2006.01) |

(52) U.S. Cl.

CPC ..... *B41J 25/3086* (2013.01); *B41J 2/155* (2013.01); *B41J 15/04* (2013.01); *B41J 25/304* (2013.01); *B41J 25/3082* (2013.01); *B41J 29/393* (2013.01); *B41J 2202/15* (2013.01)

(58) Field of Classification Search

CPC ..... B41J 2/16588

See application file for complete search history.

(56) References Cited

U.S. PATENT DOCUMENTS

| | | | | |
|---|---|---|---|---|
| 4,577,203 | A | 3/1986 | Kawamura | |
| 5,360,276 | A * | 11/1994 | Petermann | B41J 25/308 400/55 |
| 9,393,821 | B2 * | 7/2016 | Okuda | B41J 25/3082 |
| 2003/0043228 | A1 | 3/2003 | Igarashi | |

(Continued)

FOREIGN PATENT DOCUMENTS

| | | | |
|---|---|---|---|
| JP | 08-156362 | A | 6/1996 |
| JP | 2013-056464 | A | 3/2013 |

*Primary Examiner* — Shelby Fidler

(74) *Attorney, Agent, or Firm* — Foley & Lardner LLP

(57) ABSTRACT

A printer includes a printhead, a platen, a carriage, a carriage moving mechanism configured to move the carriage between an opposing position at which the printhead faces the platen and a standby position at which the printhead does not face the platen, a head moving mechanism configured to move the printhead between a first head position and a second head position when the carriage is at the opposing position, and a sensor. A first gap between the printhead and the platen when the printhead is at the first head position is smaller than a second gap between the printhead and the platen when the printhead is at the second head position. The sensor is configured to detect whether the carriage is at the opposing position and the printhead is at the second head position, or not.

12 Claims, 12 Drawing Sheets

(56) References Cited

U.S. PATENT DOCUMENTS

| | | | | |
|---|---|---|---|---|
| 2004/0080553 | A1* | 4/2004 | Kim | B41J 25/308 347/8 |
| 2004/0252161 | A1 | 12/2004 | Bibl et al. | |
| 2008/0231653 | A1* | 9/2008 | Kawashima | B41J 2/16585 347/29 |
| 2009/0284556 | A1 | 11/2009 | Okazawa et al. | |
| 2009/0284566 | A1 | 11/2009 | Suzuki et al. | |
| 2015/0116424 | A1* | 4/2015 | Nagata | B41J 2/16588 347/37 |

* cited by examiner

PRINTER AND CONTROL METHOD FOR A PRINTER

CONTINUING APPLICATION DATA

This application is a continuation of, and claims priority under 35 U.S.C. §120 on, U.S. application Ser. No. 14/590,200, filed Jan. 6, 2015, which claims priority under 35 U.S.C. §119 on Japanese application no. 2014-006461, filed Jan. 17, 2014. The content of each such related application is incorporated by reference herein in its entirety.

BACKGROUND

1. Technical Field

The present disclosure relates to a printer having a mechanism for mounting and moving a printhead on a carriage, and to a method of controlling the printer.

2. Related Art

Printers that convey sheet media over a platen surface, dispose the printhead mounted on a carriage above the platen surface, and have a carriage moving mechanism that moves the carriage carrying the printhead bidirectionally across the paper width (in the transverse direction) perpendicularly to the media conveyance direction are known from the literature. See, for example, JP-A-H08-156362. The printer taught in JP-A-H08-156362 has a home position detection sensor disposed within the range of carriage movement, detects the carriage at the home position by this sensor, and counts the number of steps a stepper motor is driven from this position to control the position of the carriage.

Some inkjet printers have a lift mechanism that raises and lowers the carriage carrying the printhead to hold the gap between the platen and the printhead to a constant distance. This configuration requires a mechanism that moves the carriage in two directions, across the paper width (horizontally) and up and down (vertically). When a large printhead such as a line inkjet head is used, the head unit including the printhead mounted on the carriage becomes accordingly large. As a result, precisely controlling the position when moving this head unit vertically and horizontally is difficult, the paper or other member may contact the printhead and become soiled with ink, and the printhead can be potentially damaged. Furthermore, if movement of the carriage or printhead stops because of some problem, recovery is difficult if the position where the carriage or printhead stopped is unknown, and the carriage or printhead may be moved in the wrong direction.

To precisely control the position of a head unit comprising a printhead mounted on a carriage, a detection mechanism that accurately detects the position of the carriage is desirable. For example, if an encoder or other sensor is mounted on the carriage, the position of the carriage can be detected throughout the full range of carriage movement. However, when the carriage moves in two directions, vertically and horizontally, two sets of encoders or other sensors must be disposed to the head unit, construction becomes complicated, the parts count rises, and the cost increases. Furthermore, because the number of parts mounted on the head unit increases and the head unit becomes even larger, moving the head unit at high speed becomes difficult and throughput drops.

SUMMARY

The present disclosure provides a construction that avoids increasing the size and complicating the configuration of a head unit carrying a printhead, and enables desirably executing a recovery process when the position of the printhead becomes unknown due to some problem, in a printer that moves and controls the position of a printhead in two directions.

One aspect of the invention is a printer including a printhead, a platen, a carriage, a carriage moving mechanism, a head moving mechanism and a sensor. The carriage supports the printhead. The carriage moving mechanism is configured to move the carriage between an opposing position at which the printhead faces the platen and a standby position at which the printhead does not face the platen. The head moving mechanism is configured to move the printhead between a first head position and a second head position. A first gap between the printhead and the platen when the printhead is at the first head position is smaller than a second gap between the printhead and the platen when the printhead is at the second head position. The sensor is configured to detect whether the carriage is at the opposing position and the printhead is at the second head position, or not.

In another aspect of the invention the sensor is disposed at a position corresponding to the opposing position.

Another aspect of the invention is a printer including a controller configured to receive a signal from the sensor and drive the carriage moving mechanism and the head moving mechanism based on the signal. The sensor outputs a first signal indicates that the carriage is at the opposing position and the printhead is at the second head position. The controller is configured to drive the head moving mechanism to move the printhead toward the first head position, if the controller receives the first signal when drive the carriage moving mechanism, and driving the carriage moving mechanism to move the carriage toward the standby position, if the controller receives the first signal when driving the head moving mechanism.

Another aspect of the invention is a printer further including another (second) sensor configured to detect the carriage if the carriage is at the standby position. The controller is configured to drive the carriage moving mechanism to move the carriage if the second sensor detects the carriage.

In another aspect of the invention the sensor is disposed at a position corresponding to the opposing position.

Another aspect of the invention is a printer further including a controller configured to receive a signal from the sensor and drive the carriage moving mechanism and the head moving mechanism based on the signal, wherein the controller is configured to drive the carriage moving mechanism to move the carriage if the sensor detects the carriage, and drive the head moving mechanism to move the printhead if the sensor detects the printhead.

Another aspect of the invention is a printer further comprising another (second) sensor configured to detect the carriage if the carriage is at the standby position. The controller is configured to drive the carriage moving mechanism to move the carriage if the second sensor detects the carriage.

Another aspect of the invention is a printer, further comprising another (second) sensor configured to detect the carriage if the carriage is at the standby position; and a controller configured to receive a first signal from the sensor and drive the head moving mechanism, and configured to receive a second signal from the second sensor and drive the carriage moving mechanism. The controller is configured to: determine that the carriage is at the opposing position if the controller receives the first signal from the sensor; and determine that the carriage is at the standby position if the controller receives the second signal from the second sensor.

Another aspect of the invention is a printer, wherein the carriage moving mechanism comprises a carriage motor configured to rotate; and an encoder configured to detect rotation of the carriage motor. The controller is further configured to determine whether the carriage is in a lock state and, if so, stop moving the carriage, if the controller does not receive the first signal from the sensor and receives a signal from the encoder.

Another aspect of the invention is a printer, wherein the controller is further configured to determine that the carriage is in an error state if the controller does not receive the first signal from the sensor and the second signal from the another sensor.

Another aspect of the invention is a printer, wherein the controller is further configured to drive the carriage moving mechanism to move the carriage to the opposing position after it is determined that the carriage is in the error state.

Another aspect of the invention is a printer, wherein the controller is further configured to drive the carriage moving mechanism to move the carriage from the standby position to the opposing position; and drive the head moving mechanism to move the printhead in a descending direction if the controller determines that the carriage is at the opposing position, after the carriage moving mechanism was driven.

Another aspect of the invention is a printer, wherein the controller is further configured to drive the head moving mechanism to move the printhead in a descending direction if the controller determines that the carriage is at the opposing position, after the carriage moving mechanism was driven; and determine that the carriage is in an error state if the controller receives the first signal from the sensor and does not receive the second signal from the another sensor after the head moving mechanism was driven.

Another aspect of the invention is a printer, wherein the controller is further configured to drive the head moving mechanism to move the printhead in a descending direction if the controller determines that the carriage is at the opposing position; drive the head moving mechanism to move the printhead in an ascending direction if the controller determines that the carriage is at the opposing position, after printhead was moved in descending direction; and determine that the carriage is in an error state if the controller does not receive the first signal from the sensor and does not receive the second signal from the another sensor after the head moving mechanism was driven.

One aspect of the invention is a control method of a printer. The control method including a carriage of the printer between an opposing position and a standby position, the opposing position being at which a printhead of the printer faces a platen of the printer and the standby position being at which the printhead does not face the platen, moving the printhead between a first head position and a second head position, a first gap between the printhead and the platen when the printhead is at the first head position being smaller than a second gap between the printhead and the platen when the printhead is at the second head position, and detecting whether the carriage is at the opposing position and the printhead is at the second head position, or not, based on a signal output by a sensor of the printer.

Other objects and attainments together with a fuller understanding of the invention will become apparent and appreciated by referring to the following description and claims taken in conjunction with the accompanying drawings.

DESCRIPTION OF EMBODIMENTS

Preferred embodiments of a printer and a control method therefor according to the present invention are described below with reference to the accompanying figures.

General Configuration

Figure 1:
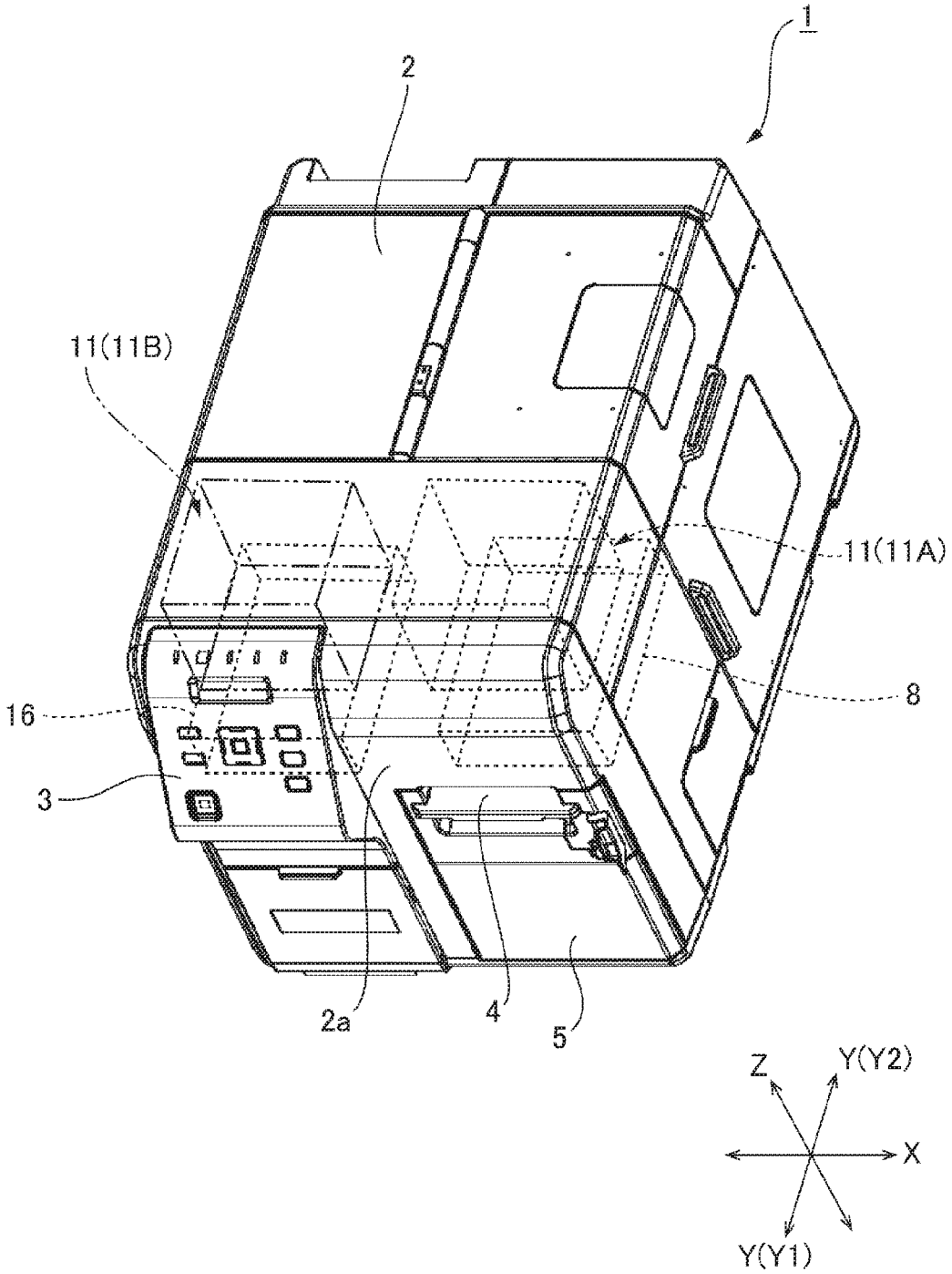
FIG. 1 is an external oblique view of a printer according to an embodiment of the invention.
Figure 2:
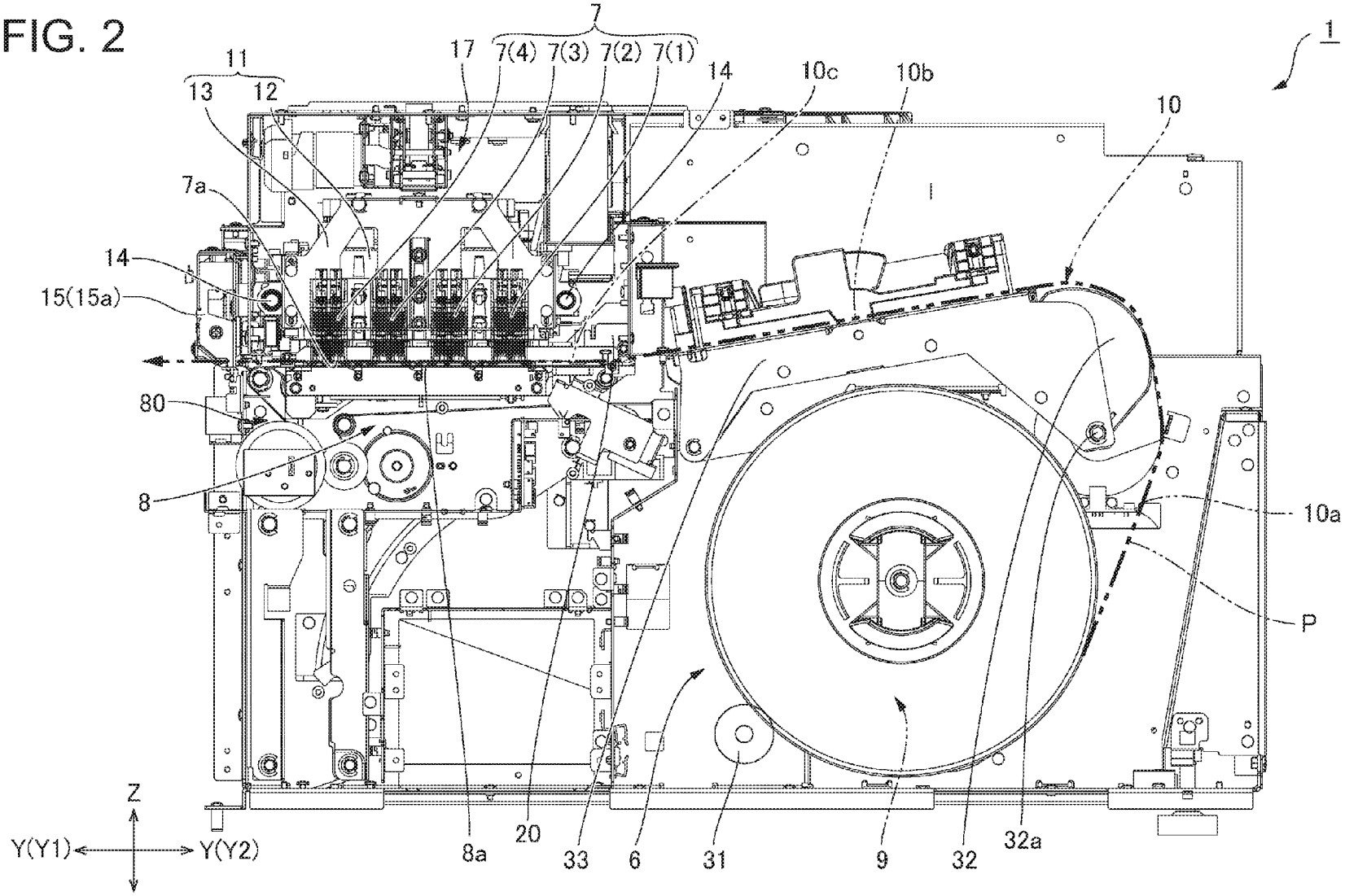
FIG. 2 is a vertical section view showing the internal configuration of the printer in FIG. 1.

FIG. 1 is an external oblique view of a printer according to the invention. FIG. 2 is a vertical section view showing the internal configuration of the printer.

As shown in FIG. 1, the printer 1 has a printer cabinet 2 that is basically box-shaped and is long from front to back. An operating panel 3 is disposed at the top of the front 2*a* of the printer cabinet 2 on one side of the width, and a paper exit 4 is formed on the other side. An access cover 5 for maintenance is disposed below the paper exit 4.

As shown in FIG. 1, the invention is described below with reference to the three mutually perpendicular directional axes X, Y, and Z, the transverse axis X across the device width, the longitudinal axis Y between the front and back of the device, and a vertical axis Z. Note also that Y1 denotes the front of the printer, and Y2 denotes the back of the printer.

As shown in FIG. 2, a roll paper compartment 6 is formed at the bottom at the back Y2 inside the printer cabinet 2. A printhead 7 is disposed at the top of the printer front Y1, and a platen unit 8 is disposed below the printhead 7 at the front Y1. The printhead 7 is disposed with the nozzle face 7*a* facing down. The platen unit 8 has a horizontal platen surface 8*a* opposite the nozzle face 7*a* of the printhead 7 with a specific platen gap G (see FIGS. 10B and 10C) therebetween.

The printhead 7 is a line inkjet head, and as shown in FIG. 2 includes four heads, a first head 7(1), second head 7(2), third head 7(3), and fourth head 7(4). These four heads are narrow and long on the transverse axis X, and are disposed at a regular interval on the longitudinal axis Y. Rows of ink nozzles that eject ink droplets are formed in the nozzle face of each head, and each row is longer than the maximum width of the recording paper P that can be used. The printhead 7 is mounted on a carriage 11.

The carriage 11 has a head frame 12 that supports the printhead 7, and a carriage frame 13 that supports the head frame 12 movably on the vertical axis Z. The printhead 7 and carriage 11 embody a head unit that is moved on the transverse axis X by a carriage moving mechanism 15 described below. The head frame 12 supporting the printhead 7 is also moved together the printhead 7 on the vertical axis Z by a head moving mechanism 17 (head moving mechanism) described below.

As shown in FIG. 2, a platen top unit 20 is disposed between the printhead 7 and carriage 11 and the platen unit 8. The platen top unit 20 is separated from the platen unit 8, and fastened to the main frame of the printer 1. The platen top unit 20 holds three ball bearings 21 (see FIG. 10) at positions where the head frame 12 and platen unit 8 overlap on the vertical axis Z. As described below, the three bearings 21 are held between the head frame 12 and the platen unit 8, and are members that hold a preset second distance L2 between the nozzle face 7*a* of the printhead 7 and the platen surface 8*a* (the platen gap G, FIG. 10).

Inside the printer cabinet 2, the continuous recording paper P pulled from the paper roll 9 in the roll paper compartment 6 is conveyed through the conveyance path 10 indicated by the imaginary line past the print position of the printhead 7 toward the paper exit 4 opened in the front 2*a* of the printer cabinet 2, and is discharged from the paper exit 4.

The paper conveyance path 10 includes a first conveyance path section 10*a* that extends diagonally upward toward the back Y2 from the roll paper compartment 6; a second conveyance path section 10*b* that curves from the top end of the first conveyance path section 10*a* toward the front Y1 and descends gradually to the platen surface 8*a*; and a third conveyance path section 10*c* that extends horizontally from the back Y2 end of the platen surface 8*a* to the front Y1 of the printer. The print position of the printhead 7 is disposed in the middle of the third conveyance path section 10*c*.

A roll spindle 31 on which the paper roll 9 is installed is disposed in the roll paper compartment 6. The roll spindle 31 extends on the transverse axis X, and is driven rotationally by drive power from a media supply motor 31*a* disposed near the bottom of the printer cabinet 2. The paper roll 9 is installed so that it cannot rotate relative to the roll spindle 31, and when the roll spindle 31 turns, the recording paper P is delivered from the paper roll 9 to the first conveyance path section 10*a* of the conveyance path 10.

A tension lever 32 that applies back tension to the recording paper P is disposed where the conveyance path 10 curves and changes direction from the first conveyance path section 10*a* to the second conveyance path section 10*b*. The distal end of the tension lever 32 has a curved outside surface, and the recording paper P is mounted thereon. The tension lever 32 is attached pivotably around a predetermined axis of rotation 32*a*, and is urged by a spring member (not shown in the figure) to the back Y2.

A paper guide 33 is disposed on the front Y1 side of the tension lever 32, and the second conveyance path section 10*b* of the conveyance path 10 is defined by the paper guide 33. The paper guide 33 is shaped to descend gently to the front Y1, and guides the recording paper P from the tension lever 32 toward the platen surface 8*a*.

Figure 3:
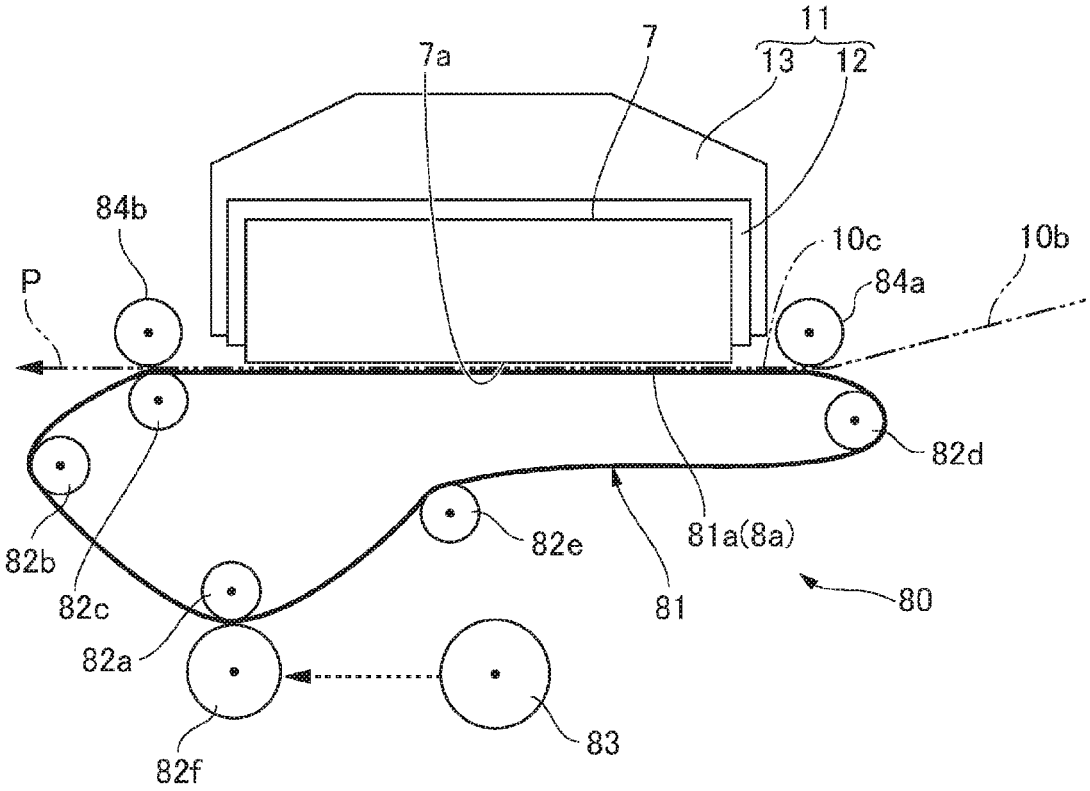
FIG. 3 schematically illustrates the media conveyance mechanism.

A belt conveyor mechanism 80 is mounted on the platen unit 8. FIG. 3 schematically illustrates the belt conveyor mechanism 80. The belt conveyor mechanism 80 includes an endless conveyor belt 81 disposed below the third conveyance path section 10*c*; plural guide rollers 82*b* to 82*e* on which the conveyor belt 81 is mounted; a drive roller 82*f* that drives the conveyor belt 81; and a conveyor motor 83 that causes the belt drive roller 82*f* to turn. The conveyor belt 81 is pressed against the belt drive roller 82*f* by the guide roller 82*a*. By driving the belt drive roller 82*f*, the conveyor belt 81 moves through the path passing the guide rollers 82*a* to 82*e*.

The portion of the conveyor belt 81 between guide rollers 82*c* and 82*d* is the horizontal belt portion 81*a* extending horizontally over the third conveyance path section 10*c*. The upstream end and the downstream end of the horizontal belt portion 81*a* in the conveyance direction (that is, the longitudinal axis Y) are pressed from above the platen unit 8 by the pinch rollers 84*a*, 84*b*. The belt conveyor mechanism 80 conveys the recording paper P between the pinch rollers 84*a*, 84*b* and the horizontal belt portion 81*a*.

Carriage Moving Mechanism

A pair of parallel carriage guide rails 14 are disposed extending on the transverse axis X in front and back of the carriage 11 on the longitudinal axis Y. The carriage 11 is supported movably on the transverse axis X by this pair of carriage guide rails 14. A carriage moving mechanism 15 is disposed on the front Y1 side of the carriage 11.

The carriage moving mechanism 15 has a pair of timing pulleys (not shown in the figure), a timing belt (not shown in the figure), a carriage motor 15*a*, and an encoder 15*b* (see FIG. 9) that detects rotation of the carriage motor 15*a*. The pair of timing pulleys are disposed near the opposite ends of the carriage guide rails 14. The timing belt is mounted on the pair of timing pulleys, and the timing belt is fastened at one place to the carriage 11. When the carriage motor 15*a* is driven, the pair of timing pulleys turn and the timing belt moves. As a result, the carriage 11 moves bidirectionally on the transverse axis X along the pair of carriage guide rails 14.

The carriage 11 moves between the opposing position 11A indicated by the dotted line in FIG. 1, and the standby position 11B indicated by the double-dotted line in FIG. 1.

When the carriage 11 is at the opposing position 11A, the printhead 7 mounted on the carriage 11 is opposite the platen unit 8. When the carriage 11 is at the standby position 11B, the printhead 7 mounted on the carriage 11 is not opposite the platen unit 8. A head maintenance unit 16 is disposed below the standby position 11B. When the carriage 11 moves to the standby position 11B, the printhead 7 is opposite the head maintenance unit 16.

First Sensor

Figure 4A:
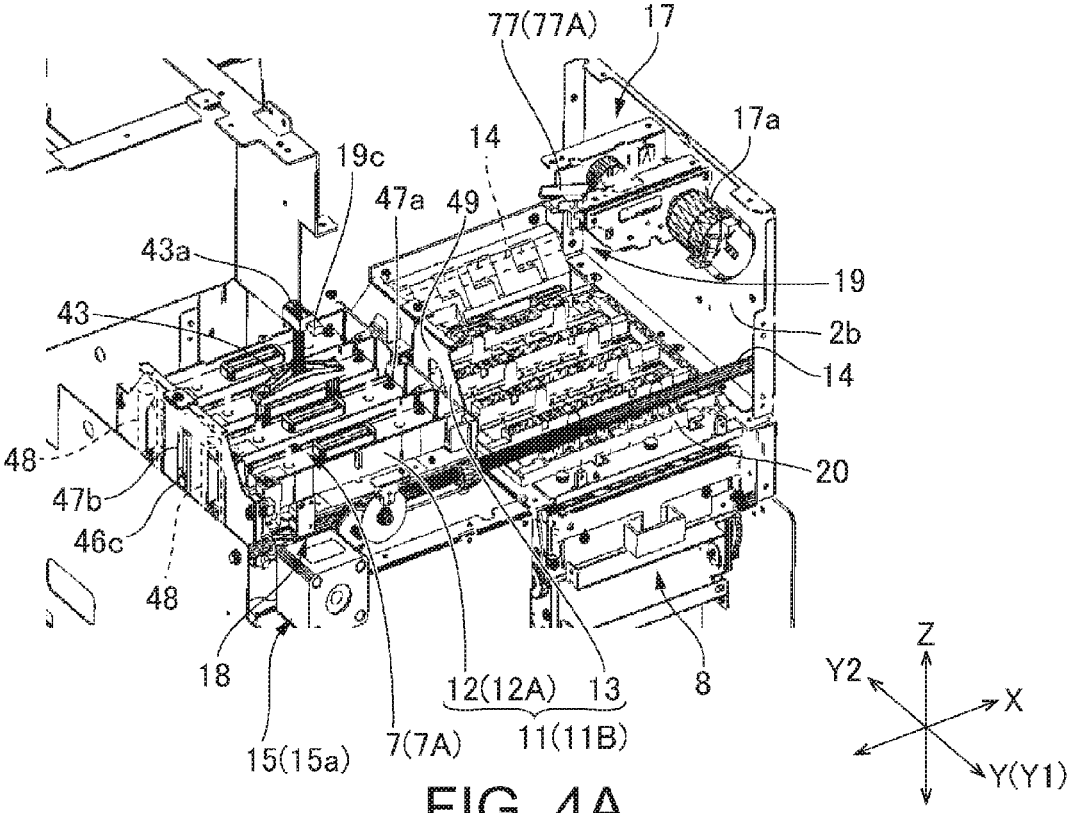
FIGS. 4A and 4B are oblique views showing part of the internal mechanism of the printer.
Figure 4B:
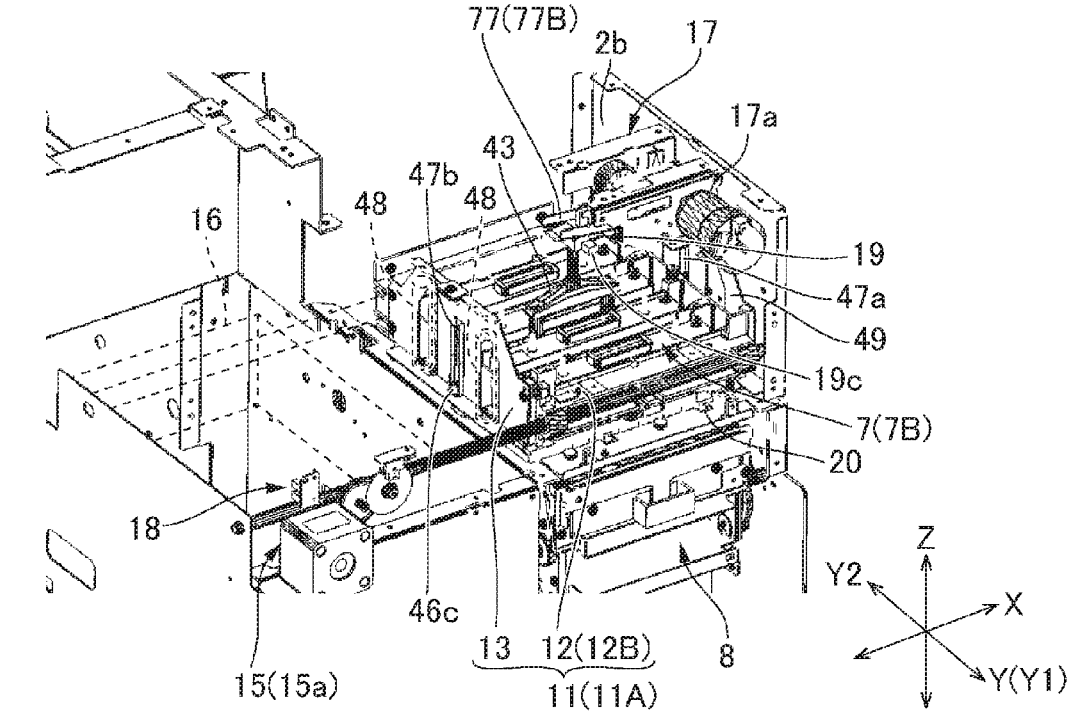
Figure 5A:
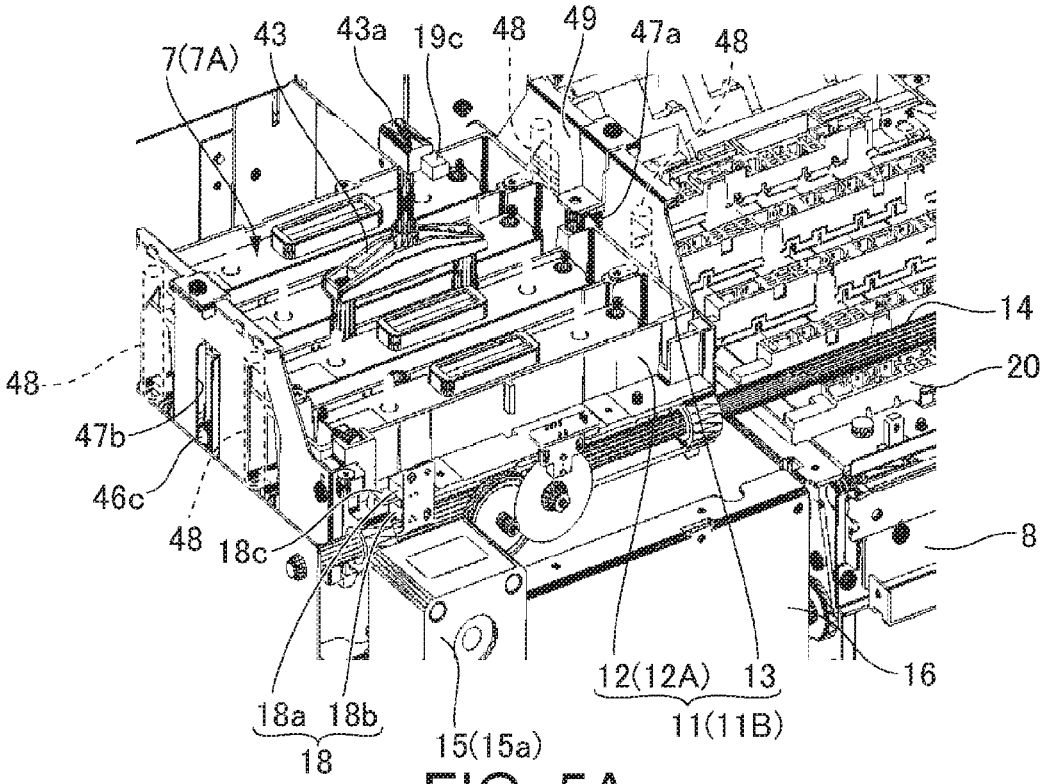
FIGS. 5A and 5B illustrate a first sensor for detecting the carriage.
Figure 5B:
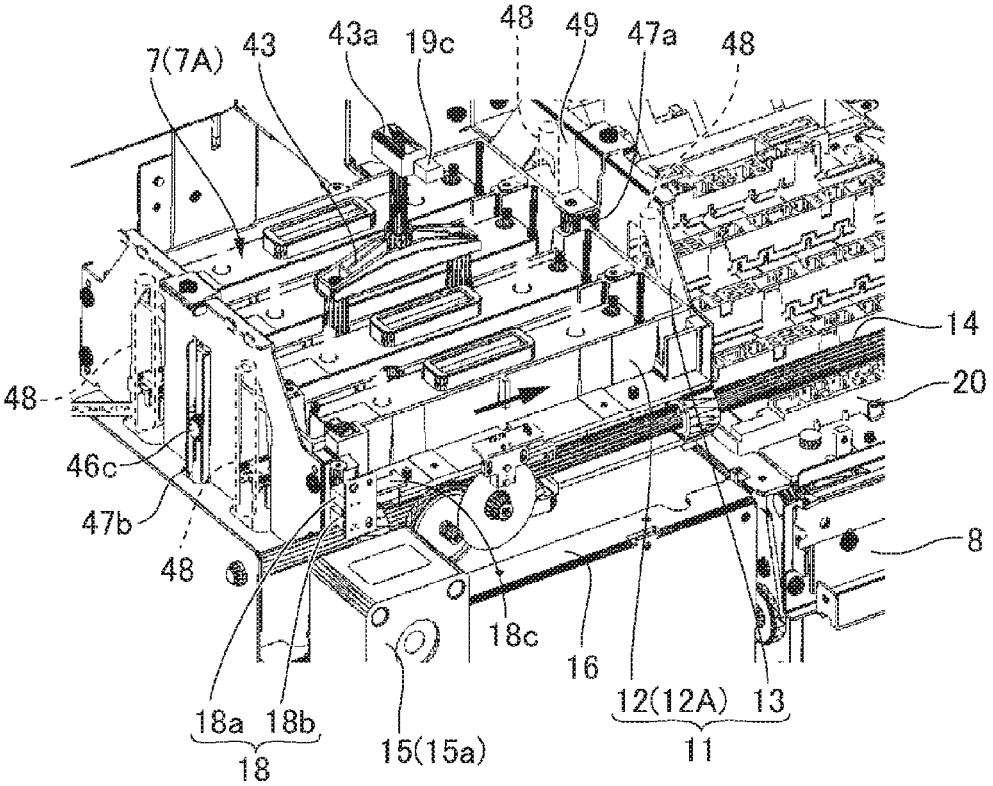

FIG. 4 is an oblique view illustrating part of the internal configuration of the printer 1, FIG. 4A showing the carriage 11 at the standby position 11B, and FIG. 4B showing the carriage 11 at the opposing position 11A. FIG. 5 illustrates the first sensor that detects the carriage 11, FIG. 5A showing when the carriage 11 is detected, and FIG. 5B showing when the carriage 11 is not detected. As shown in FIG. 4 and FIG. 5, a first sensor 18 that detects the carriage 11 in the standby position 11B (first detection position) is disposed near the end of the carriage guide rails 14 at the front Y1. This first sensor 18 is an optical sensor, and includes an emitter 18*a* and a receptor 18*b* facing each other on the vertical axis Z. The carriage 11 has a flat interrupter 18*c* projecting at the front Y1 from the side of the carriage frame 13.

As shown in FIG. 5A, when the carriage 11 is at the standby position 11B, the interrupter 18*c* intervenes between the emitter 18*a* and receptor 18*b* and breaks the detection beam. When the carriage 11 moves from the standby position 11B toward the opposing position 11A, the interrupter 18*c* leaves the gap between the emitter 18*a* and receptor 18*b* as shown in FIG. 5B. The first sensor 18 detects the carriage 11 at the standby position 11B by this mechanism.

Carriage Construction

Figure 6A:
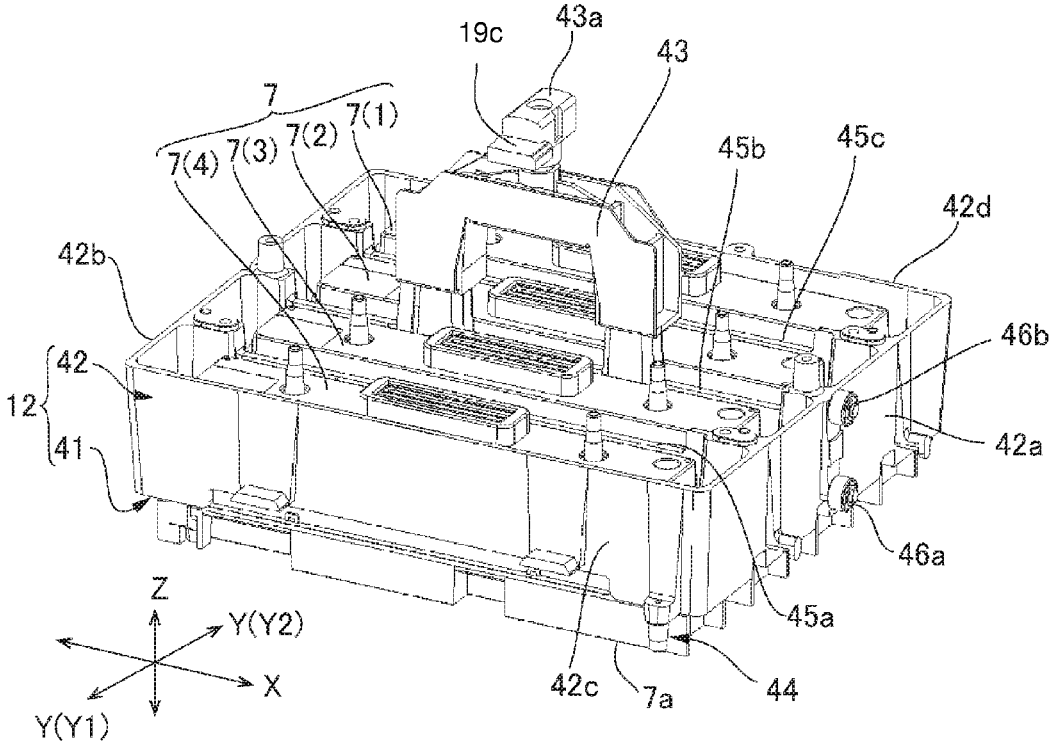
FIGS. 6A and 6B are oblique views of the head frame and the printhead removed from the carriage frame.
Figure 6B:
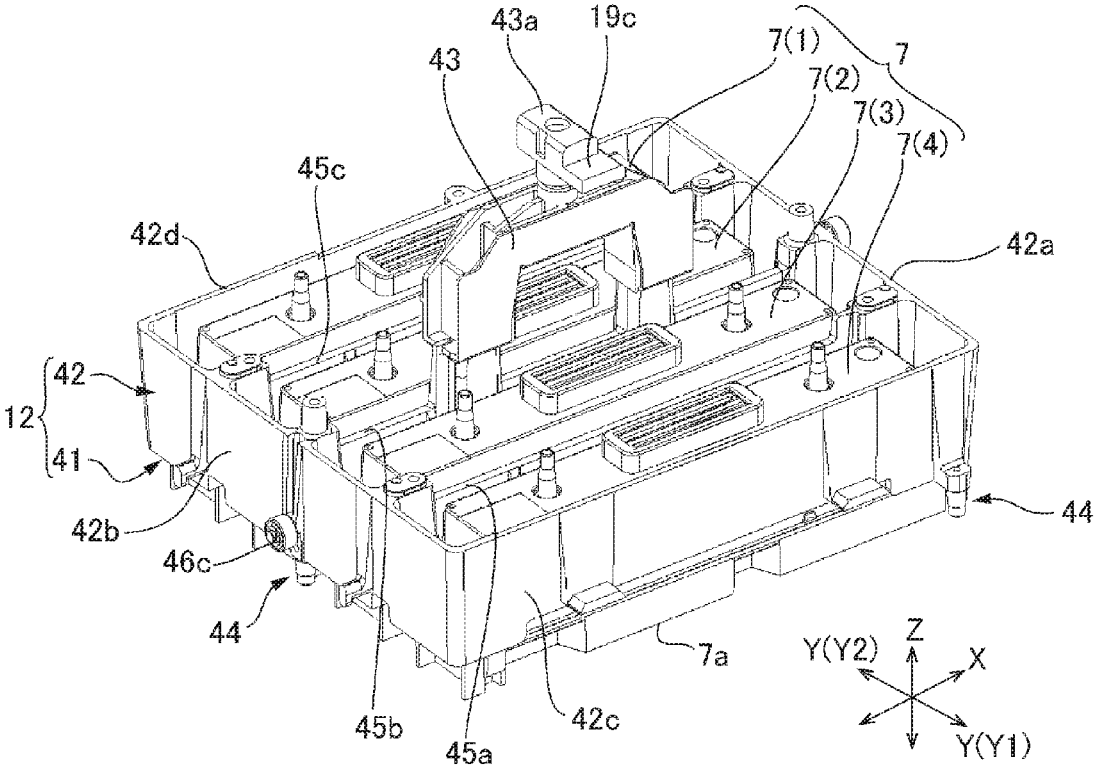

FIG. 6 is an oblique view of the head frame 12 and printhead 7 removed from the carriage frame 13, FIGS. 6A and 6B respectively being oblique views from one side and the other side on the transverse axis X. As described above, the head frame 12 that supports the printhead 7 is supported movably on the vertical axis Z by the carriage frame 13.

As shown in FIGS. 6A and 6B, the head frame 12 includes a rectangular bottom 41, a side wall unit 42 that rises vertically from the outside edges of the bottom 41, and an operating unit 43 that protrudes from the center part of the bottom 41 to a height above the top of the side wall unit 42.

The four line heads (first head 7(1) to fourth head 7(4)) of the printhead 7 are inserted from above to the side wall unit 42, and are held in the head frame 12 with the bottom parts of the heads protruding down from openings formed in the bottom 41. Head stops 44 are formed to the bottom 41 at positions that can contact the three bearings 21 held by the platen top unit 20.

The side wall unit 42 has a first wall section 42*a* and a second wall section 42*b* extending on the longitudinal axis Y, and a third wall section 42*c* and a fourth wall section 42*d* that extend on the transverse axis X.

Three reinforcing panels 45*a* to 45*c* that connect the first wall section 42*a* and the second wall section 42*b* are disposed between the four line heads (first head 7(1) to fourth head 7(4)) arranged on the longitudinal axis Y inside the side wall unit 42. Of the three reinforcing panels 45*a* to 45*c*, the reinforcing panel 45*b* in the center on the longitudinal axis Y is formed integrally with the operating unit 43. A stop 43*a* that contacts the operating lever 77 (see FIG. 7) of the head moving mechanism 17 is disposed to the top part of the operating unit 43, and a pressure portion 19*c* is formed protruding to the front Y1 from the stop 43*a*. When the head frame 12 moves up or down, the signal from the second sensor 19 described below is changed by the pressure portion 19*c*.

As shown in FIG. 6A, a first bottom guide roller 46*a* and a first top guide roller 46*b* are disposed to the first wall section 42*a* in the center on the longitudinal axis Y and separated from each other on the vertical axis Z. As shown in FIG. 6B, a second guide roller 46*c* is disposed to the second wall section 42*b* at the middle on the longitudinal axis Y. The second guide roller 46*c* is disposed coaxially to the first bottom guide roller 46*a*.

As shown in FIGS. 5A and 5B, the carriage frame 13 is shaped like a picture frame, and supports the head frame 12 inside the carriage frame 13.

A first guide channel 47*a* is formed on the vertical axis Z in the outside of the first wall section 42*a* of the head frame 12. A second guide channel 47*b* extending on the vertical axis Z is formed in the second wall section 42*b* of the head frame 12. When the head frame 12 is placed inside the carriage frame 13, the first bottom guide roller 46*a* and first top guide roller 46*b* are inserted to the first guide channel 47*a*, and the second guide roller 46*c* is inserted to the second guide channel 47*b*. As a result, the head frame 12 is supported by the carriage frame 13 movably between an up position 12A (see FIGS. 10A and 10B) where the first top guide roller 46*b* is in the top part of the first guide channel 47*a*, and a down position 12B (see FIG. 10C) where the first bottom guide roller 46*a* is in the bottom part of the first guide channel 47*a*. The printhead 7 is at the first head position 7A (see FIGS. 10A and 10B) when the head frame 12 is at the up position 12A, and is at a second head position 7B (see FIG. 10C) when the head frame 12 is at the down position 12B.

Four coil springs 48 are disposed between the head frame 12 and the carriage frame 13. The head frame 12 is urged to the up position 12A by the urging force of the four coil springs 48.

Head Moving Mechanism

Figure 7:
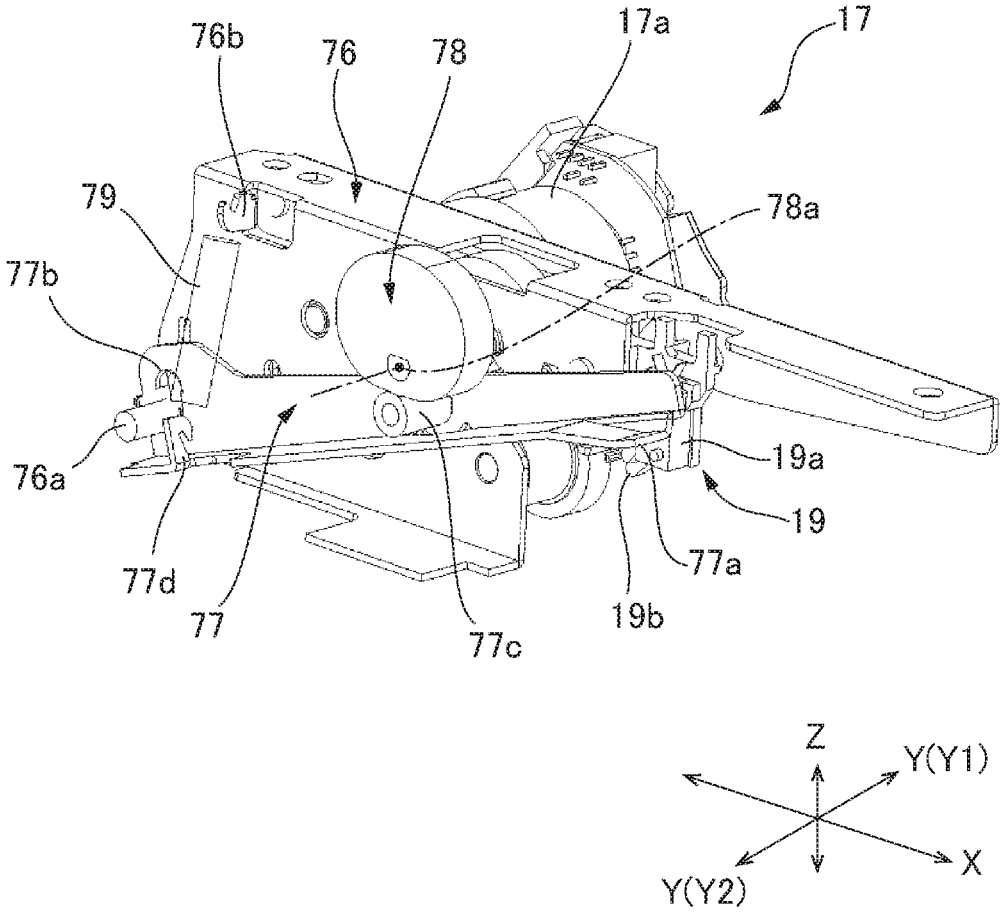
FIG. 7 is an oblique view of the head moving mechanism.

FIG. 7 is an oblique view of the head moving mechanism 17.

The head moving mechanism 17 includes a frame 76 with a support pin 76*a* extending to the printer back Y2; an operating lever 77 extending on the transverse axis X; an eccentric cam 78 disposed above the support pin 76*a* and the operating lever 77; a cam drive motor 17*a* (head moving motor) as the drive source of the eccentric cam 78; an encoder 17*b* (see FIG. 9) that detects rotation of the cam drive motor 17*a*; and a coil spring 79.

The operating lever 77 has an operating part 77*a* at on end on the transverse axis X that can contact the operating unit 43 of the head frame 12, and an oval hole 77*b* at the other end. The support pin 76*a* is inserted to the oval hole 77*b*.

A cam follower 77*c* that contacts the cam surface (outside surface) of the eccentric cam 78 is disposed between the operating part 77*a* and the oval hole 77*b* of the operating lever 77. The bottom end of the coil spring 79 is held at a position near the oval hole 77*b* between the cam follower 77*c* and the oval hole 77*b*. The top end of the coil spring 79 is held by the top edge of the frame 76. The coil spring 79 urges the operating lever 77 up.

When the cam drive motor 17*a* is driven, the eccentric cam 78 turns, and the cam follower 77*c* moves vertically. As a result, the operating lever 77 moves between the lever-up position 77A where the operating part 77*a* is positioned above the axis of rotation 78*a* of the eccentric cam 78 (see FIGS. 10A and 10B), and the lever-down position 77B where the operating part 77*a* is lower than the axis of rotation 78*a* of the eccentric cam 78 (FIG. 10C).

When the carriage 11 is set to the opposing position 11A, the operating part 77*a* of the operating lever 77 extends to a position vertically above the stop 43*a* of the head frame 12. When the operating lever 77 moves from this position toward the lever-down position 77B, the head frame 12 is pushed down against the urging force of the coil spring 65. As a result, the head frame 12 and the printhead 7 supported thereby descend together.

Second Sensor

Figure 8A:
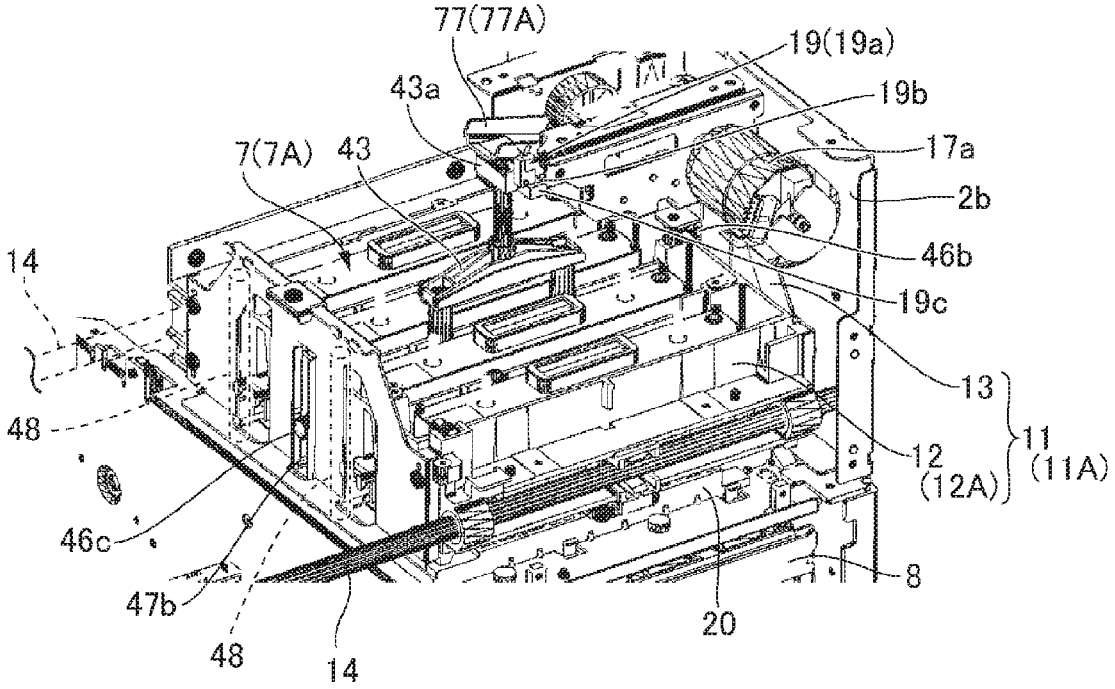
FIGS. 8A and 8B illustrate a second sensor for detecting the head frame.
Figure 8B:
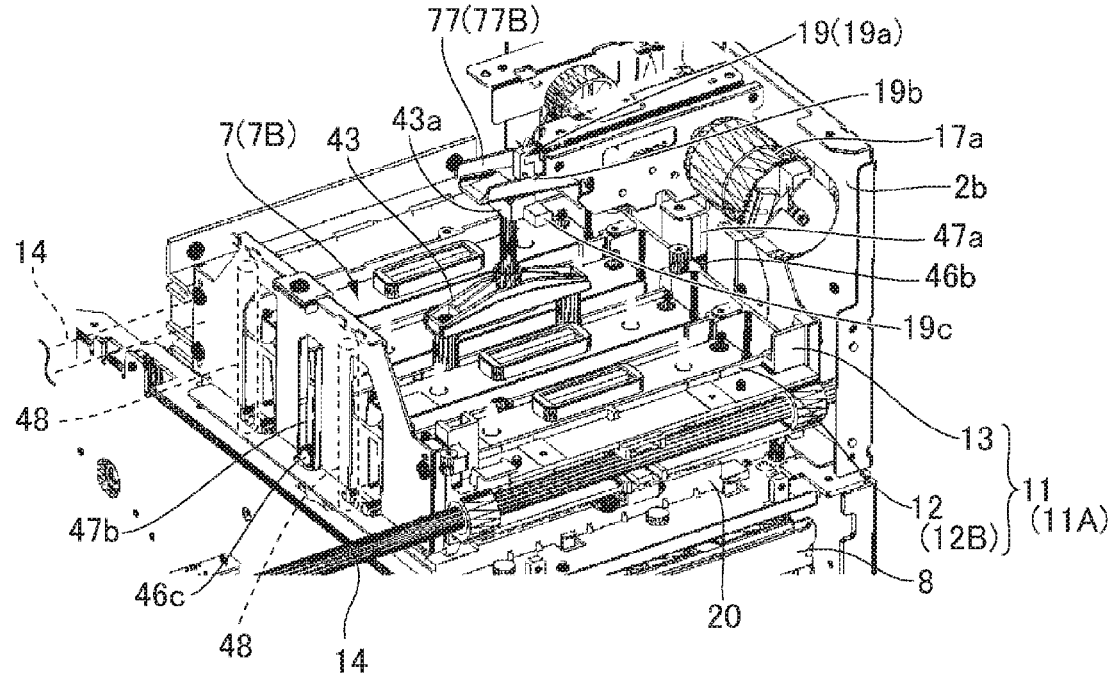

FIG. 8 illustrates the second sensor that detects the head frame 12, FIG. 8A showing when the head frame 12 is detected, and FIG. 8B showing when the head frame 12 is not detected.

As shown in FIG. 7 and FIG. 8, a second sensor 19 that detects the head frame 12 at the up position 12A is disposed near the distal end of the frame 76 of the head moving mechanism 17. This second sensor 19 is a mechanical sensor, and has a sensor body 19*a* attached to the frame 76, and a moving part 19*b* that protrudes below the sensor body 19*a*, that is, to the platen surface 8*a* side. As described below, the second sensor 19 is disposed at the position where operation changes between movement of the carriage 11 on the transverse axis X by the carriage moving mechanism 15, and movement of the head frame 12 and printhead 7 on the vertical axis Z by the head moving mechanism 17. As a result, in addition to being able to detect the head frame 12 at the up position 12A, and the printhead 7 at the first head position 7A (second detection position), the carriage 11 can also be detected at the opposing position 11A.

As described above, the head frame 12 has a pressure portion 19*c* protruding to the front Y1 of the stop 43*a*. The pressure portion 19*c* is disposed to a position aligned with the moving part 19*b* on the vertical axis Z when the carriage 11 is at the opposing position 11A.

As shown in FIG. 8A, when the operating lever 77 is at the lever-up position 77A, the head frame 12 is at the up position 12A, and the moving part 19*b* is pushed up by the pressure portion 19*c*.

As shown in FIG. 8B, when the operating lever 77 is at the lever-down position 77B, the head frame 12 is pushed down to the down position 12B, and the pressure portion 19*c* therefore moves down and separates from the moving part 19*b*. As a result, the moving part 19*b* returns to the position projecting down. By means of this mechanism, the second sensor 19 can detect the head frame 12 at the up position 12A, and through the head frame 12 detects the printhead 7 at the first head position 7A.

Control System

Figure 9:
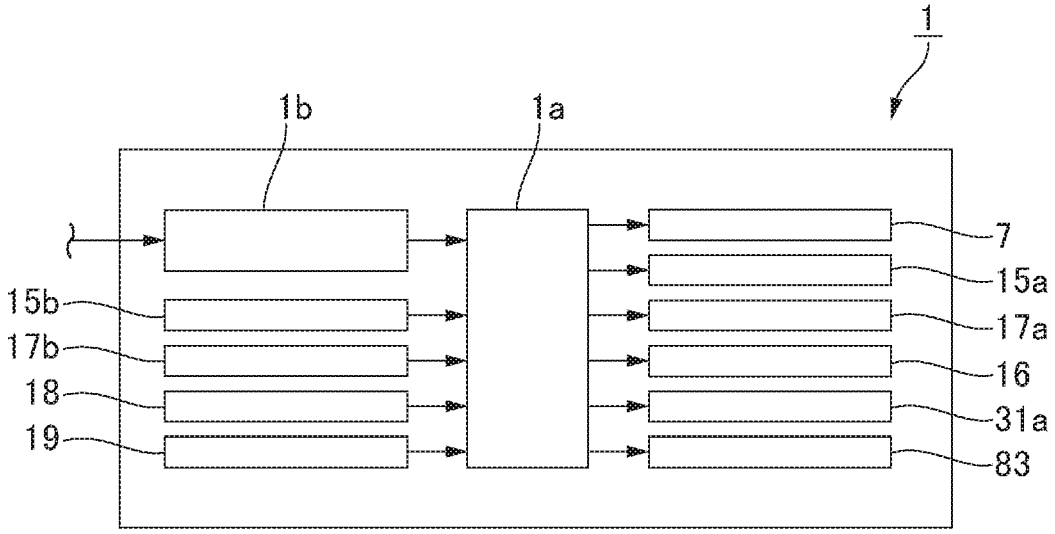
FIG. 9 is a block diagram illustrating the control system of the printer 1.

FIG. 9 is a block diagram illustrating the control system of the printer 1. The control system of the printer 1 is built around a control unit 1*a* including a CPU. Connected to the input side of the control unit 1*a* are a communication unit 1*b* that communicatively connects a computer or other external device to the printer 1; the encoder 15*b* of the carriage moving mechanism 15; the encoder 17*b* of the head moving mechanism 17; the first sensor 18 and second sensor 19; an encoder (not shown in the figure) that detects movement of the belt of the belt conveyor mechanism 80; a paper detector (not shown in the figure) that detects the recording paper P at a paper detection position on the conveyance path 10; and an encoder (not shown in the figure) that detects the rotational angle of the tension lever 32. Connected to the output side of the control unit 1*a* are the printhead 7, carriage motor 15*a*, head maintenance unit 16, media supply motor 31*a*, cam drive motor 17*a*, and conveyor motor 83.

As shown in FIG. 2, the recording paper P is pulled from the paper roll 9 loaded in the roll paper compartment 6 to the first conveyance path section 10*a* of the conveyance path 10. The recording paper P then wraps around the tension lever 32, and the leader is set passing through the second conveyance path section 10*b* and third conveyance path section 10*c*.

When print data is input to the communication unit 1*b*, the control unit 1*a* controls driving the media supply motor 31*a* to turn the roll spindle 31 and feed the recording paper P from the paper roll 9. The leading end of the recording paper P is then indexed to the print position of the printhead 7 by the conveyance operation of the belt conveyor mechanism 80. The control unit 1*a* also controls driving the carriage moving mechanism 15 and head moving mechanism 17 to position the printhead 7 opposite the platen surface 8*a* at a position maintaining the platen gap G enabling printing. The belt conveyor mechanism 80 then continues the conveyance operation continuously conveying the recording paper P at a constant speed forward from the print position to the paper exit 4. The control unit 1*a* also controls driving the printhead 7 synchronized to this conveyance operation to print on the front of the recording paper P. When printing ends, the control unit 1*a* again controls driving the carriage moving mechanism 15 and head moving mechanism 17 to set the printhead 7 opposite the head maintenance unit 16, cap the nozzle face 7*a*, and enter the standby mode.

Printer and Carriage Operation

FIG. 10 illustrates the operation of the printhead 7 and carriage 11. Note that the platen top unit 20 and the platen unit 8 are not shown in FIG. 10, which shows only the positions of the bearings 21 held by the platen top unit 20 and the platen surface 8*a*.

Figure 10A:
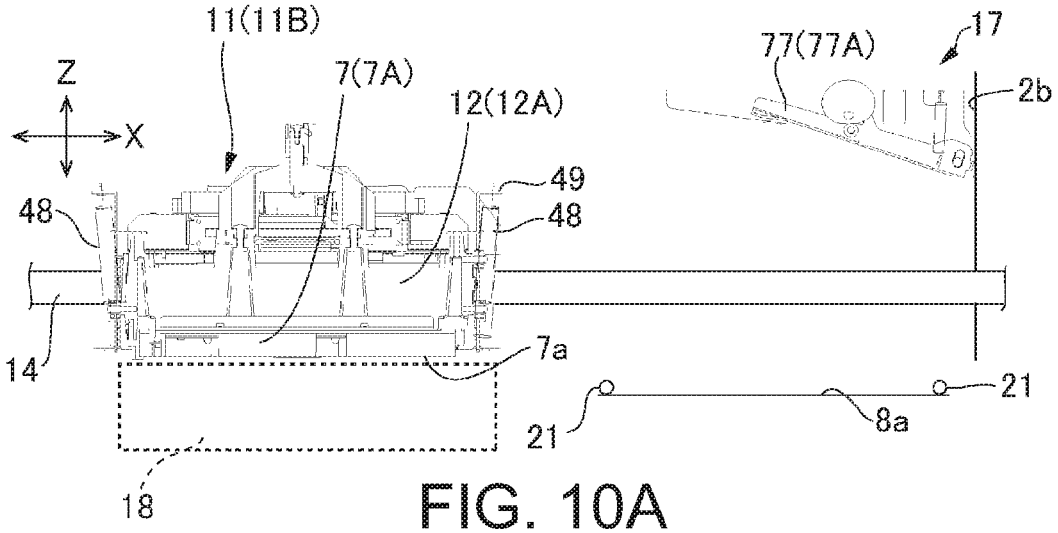
FIGS. 10A, 10B and 10C illustrate operations of the printhead and carriage.

As shown in FIG. 10A, when the printer 1 is in the standby mode, the carriage 11 is at the standby position 11B. At this time, the printhead 7 is retracted from above the platen unit 8 and is opposite the head maintenance unit 16. The head frame 12 carrying the printhead 7 is also raised to the up position 12A by the urging force of the coil springs 48. When the printer 1 is in the standby mode for an extended time, the head cap of the head maintenance unit 16 rises and caps the nozzle face 7*a* of the printhead 7.

When print data is supplied to the printer 1, the control unit 1*a* of the printer 1 drives the carriage motor 15*a*. As a result, the carriage 11 is moved from the standby position 11B along the carriage guide rails 14 above the platen unit 8, and moves to the opposing position 11A shown in FIG. 10B. While the carriage 11 is being moved by the carriage moving mechanism 15, the head frame 12 is at the up position 12A and the printhead 7 is at the first head position 7A. The printhead 7 can therefore move on the transverse axis X while the platen gap G to the platen unit 8 is held at a first distance L1 that is greater than the thickness of the platen top unit 20.

Figure 10B:
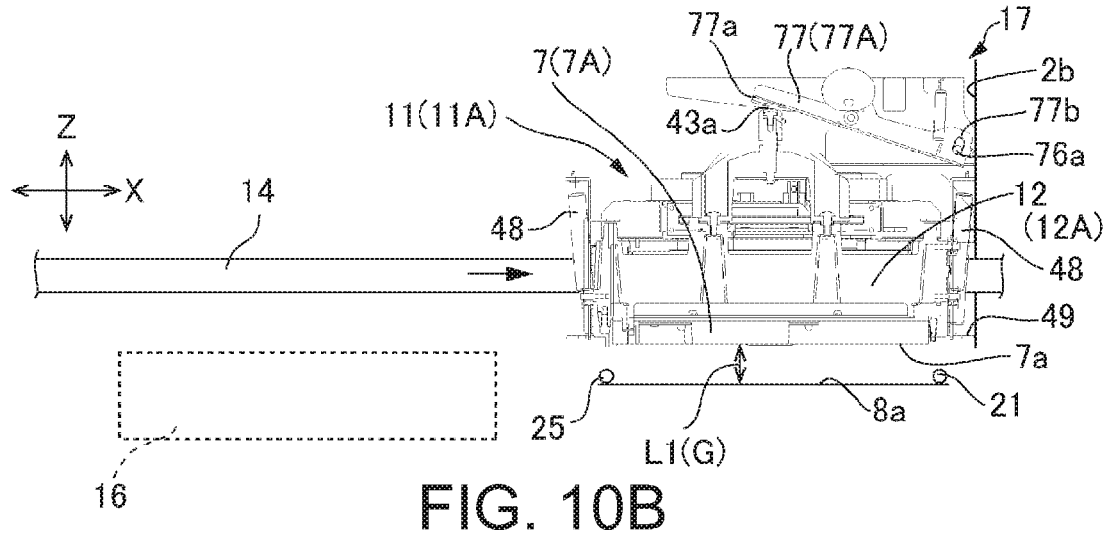
Figure 10C:
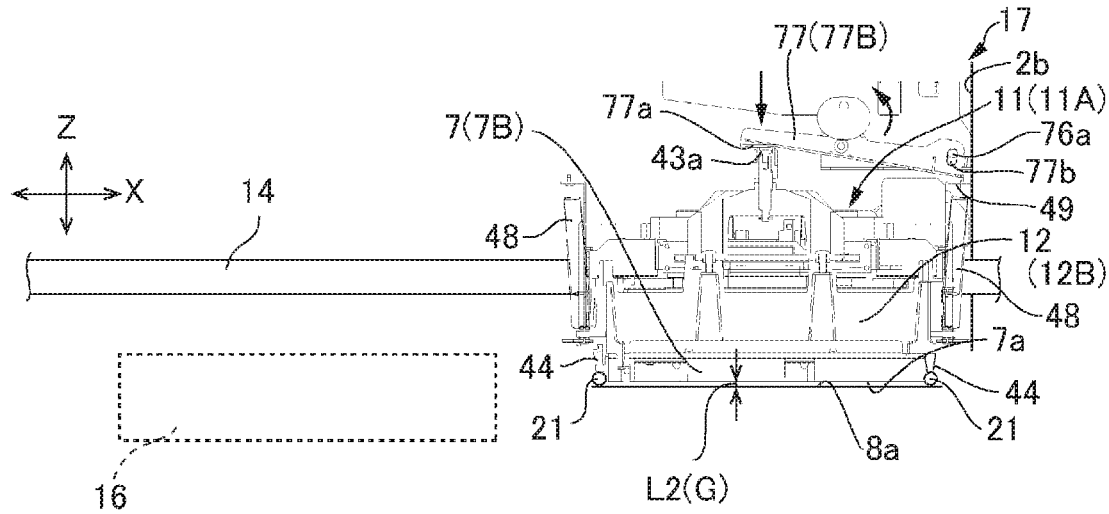

When the carriage 11 reaches the opposing position 11A, the nozzle face 7*a* of the printhead 7 is opposite the platen surface 8*a* as shown in FIG. 10B. The stop 43*a* of the head frame 12 is positioned below the operating part 77*a* of the operating lever 77 of the head moving mechanism 17 at the lever-up position 77A. Because the operating lever 77 rotates down when the cam drive motor 17*a* is driven from this position, the operating part 77*a* pushes the head frame 12 down through the intervening stop 43*a*. As a result, the head frame 12 descends from the up position 12A in resistance to the urging force of the coil springs 48, and approaches the platen surface 8*a*. When the operating lever 77 moves to the lever-down position 77B, the head frame 12 is set to the down position 12B as shown in FIG. 10C. At this time, the three bearings 21 held on the platen top unit 20 contact both the head frame 12 and the platen unit 8.

As a result, the platen gap G between the printhead 7 and platen unit 8 is a constant second distance L2, which is shorter than the diameter of the bearings 21.

Printing by the printhead 7 is possible when the platen gap G is second distance L2.

Therefore, the control unit of the printer 1 controls the conveyance operation conveying the recording paper P at a constant speed, and a printing operation that drives the printhead 7 to print, and prints the print data on the face of the recording paper P.

When printing the print data ends, the printhead 7 is returned to the position opposite the head maintenance unit 16. More specifically, the cam drive motor 17*a* is driven in reverse, and the operating lever 77 is returned from the down position 12B to the lever-up position 77A. The head frame 12 rises due to the urging force of the coil springs 48 while the operating lever 77 rises to the lever-up position 77A, and returns to the up position 12A as shown in FIG. 10B. The carriage motor 15*a* is then driven in reverse, and the carriage 11 returns from the opposing position 11A to the standby position 11B as shown in FIG. 10A.

Positioning Control of the Printhead 7 and Carriage 11 Using Sensors

Figure 11:
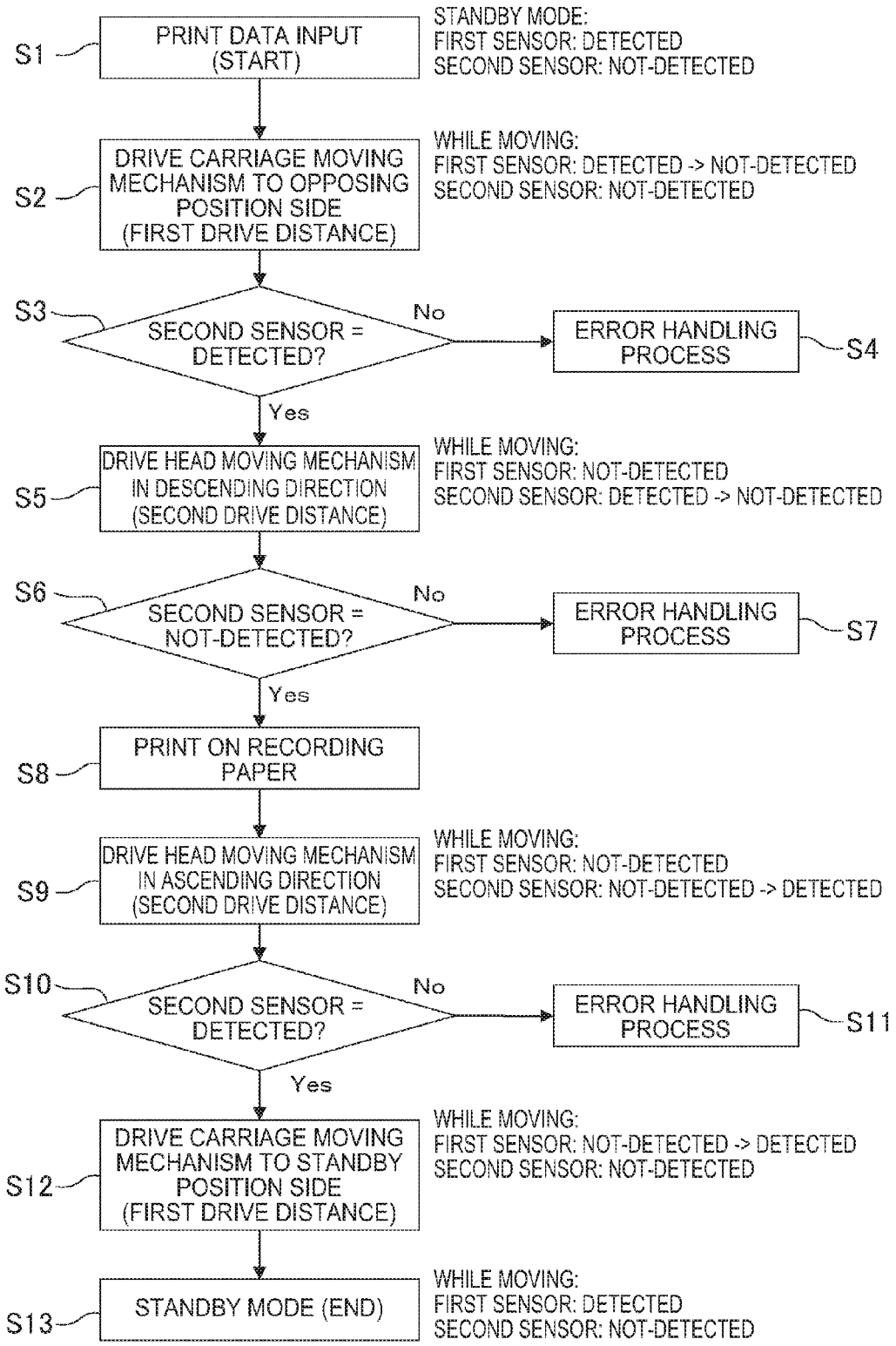
FIG. 11 is a flow chart of the process controlling the position of the printhead and carriage.

FIG. 11 is a flow chart of the process controlling the positions of the printhead 7 and carriage 11, and describes the operation illustrated in FIGS. 10A to 10C.

The control unit 1*a* of the printer 1 controls the positions of the printhead 7 and the carriage 11 based on the signals from the first sensor 18 and the encoder 15*b*, and the signals from the second sensor 19 and the encoder 17*b*.

When print data is supplied to the printer 1 in the standby mode (step S1), the first sensor 18 is in the Detected state (more specifically, the receptor 18*b* is not receiving the detection beam) because the carriage 11 is in the standby position 11B. The position of the carriage 11 can therefore be determined at this time based on the signal from the first sensor 18.

When driving the carriage motor 15*a* starts from this position, the control unit 1*a* sets the direction of rotation of the carriage motor 15*a* to the direction of rotation moving the carriage 11 to the opposing position 11A side. The control unit 1*a* then drives the carriage motor 15*a* a preset first drive distance (step S2). The drive distance of the carriage motor 15*a* is calculated based on the signals from the encoder 15*b*. The first drive distance is the angle of rotation corresponding to the distance the carriage 11 moves when moving from the standby position 11B to the opposing position 11A. When the carriage 11 starts moving to the opposing position 11A side, the signal from the first sensor 18 goes from the Detected state to the Not-Detected state.

When a stepper motor is used as the carriage motor 15*a*, the control unit 1*a* can detect loss of synchronization in step S2 from the drive pulse signal supplied to the carriage motor 15*a* and the pulse signal from the encoder 15*b*, and can detect when the carriage 11 is not moving as expected according to the drive pulse signal. For example, if the signal from the encoder 15*b* stops changing before the carriage motor 15*a* has driven less than the first drive distance even though the drive pulse signal is applied, an error handling process can be initiated because the carriage 11 is prevented from moving to the opposing position 11A by a paper jam or other problem.

When the carriage 11 reaches the opposing position 11A, the head frame 12 is at the up position 12A. As a result, if the carriage 11 reaches the opposing position 11A, the moving part 19*b* of the second sensor 19 is pushed up by the pressure portion 19*c* of the head frame 12, and the second sensor 19 changes to the Detected state. If the signal from the second sensor 19 does not change to the Detected state (step S3 returns NO) even though the carriage motor 15*a* has been driven the first drive distance, the control unit 1*a* determines a problem has occurred and executes an error handling process (step S4).

However, if the signal from the second sensor 19 changes to the Detected state when the carriage motor 15*a* has been driven the first drive distance (step S3 returns YES), the control unit 1*a* ends operation of the carriage 11 and controls the head moving mechanism 17 to lower the head frame 12 and printhead 7. Because the signal from the second sensor 19 indicates Detected at this time, the position of the carriage 11 on the transverse axis X is identified, and the positions of the head frame 12 and printhead 7 on the vertical axis Z are identified, by the second sensor 19.

If driving the cam drive motor 17*a* starts from this position, the control unit 1*a* sets the direction of rotation of the cam drive motor 17*a* to the direction of rotation moving the head frame 12 and the printhead 7 to the platen unit 8 side, that is, the direction moving the operating lever 77 to the lever-down position 77B side. The control unit 1*a* drives the cam drive motor 17*a* a preset second drive distance (step S5). The amount the cam drive motor 17*a* is driven is calculated based on signals from the encoder 17*b*. The second drive distance is the angle of rotation corresponding to the distance the head frame 12 moves when moving from the up position 12A to the down position 12B. When the head frame 12 and printhead 7 start descending, the signal from the second sensor 19 goes from the Detected state to the Not-Detected state.

When a stepper motor is used as the cam drive motor 17*a*, the control unit 1*a* can detect loss of synchronization from the drive pulse signal supplied to the cam drive motor 17*a* and the pulse signal from the encoder 17*b*. The control unit 1*a* can therefore detect when the head frame 12 and printhead 7 are not moving as expected according to the drive pulse signal. For example, if the signal from the encoder 17*b* stops changing before the cam drive motor 17*a* has been driven the second drive distance even though the drive pulse signal is applied, an error handling process can be initiated because the head frame 12 is prevented from moving to the platen unit 8 side (the down position 12B side) by a paper jam or other problem.

If the signal from the second sensor 19 does not change to the Not-Detected state (step S6 returns NO) even though the cam drive motor 17*a* has been driven the second drive distance, the control unit 1*a* determines a problem has occurred and executes an error handling process (step S7). If the signal from the second sensor 19 changes to the Not-Detected state, loss of synchronization is not detected, and the cam drive motor 17*a* is driven the second drive distance, the control unit 1*a* stops operation of the head moving mechanism 17 and controls printing on the recording paper P (step S8).

When printing ends and the standby mode is resumed, the first sensor 18 and the second sensor 19 both output the Not-Detected signal. The control unit 1*a* then controls the head moving mechanism 17 to raise the head frame 12 and printhead 7 from the position (step S9). More specifically, the control unit 1*a* drives the cam drive motor 17*a* to turn the second drive distance in the opposite direction as the direction of rotation when lowering the head frame 12 and printhead 7. If the cam drive motor 17*a* is driven the second drive distance but the signal from the second sensor 19 does not change to the Detected state (step S10 returns NO), the control unit 1*a* determines a problem occurred and executes an error handling process (step S11).

However, if the cam drive motor 17*a* drives the second drive distance and the signal from the second sensor 19 changes to the Detected state (step S10 returns YES), the control unit 1*a* ends the lifting operation of the head frame 12 and printhead 7, and changes to moving the carriage by the carriage moving mechanism 15. At this time, because the signal from the second sensor 19 is in the Detected state, the positions of the head frame 12 and the printhead 7 on the vertical axis Z, and the position of the carriage 11 on the transverse axis X, are determined by the second sensor 19. The control unit 1*a* then drives the carriage motor 15*a* the first drive distance in the opposite direction of rotation as when moving to the opposing position 11A side (step S12). When the carriage 11 returns to the standby position 11B, the first sensor 18 signal changes to Detected. The control unit 1*a* then goes to the standby mode after the position of the carriage 11 is determined (step S13).

Recovery Process from an Unknown State

As described above, it is possible in this printer 1 for both the first sensor 18 and second sensor 19 to be in a Not-Detected state, and the position of the carriage 11 on the transverse axis X, and the positions of the head frame 12 an d7 on the vertical axis Z, to be unknown. Referred to below as an unknown state, this can occur, for example, in steps S2, S5, S9, and S12 in the flow chart shown in FIG. 11. If printer 1 operation stops in this event because a problem occurred and the encoder signals are reset, the current position of the carriage 11 and printhead 7 will be unknown when operation resumes. To determine the position of the printhead 7 on the transverse axis X and the vertical axis Z without damaging the printhead 7 when such an unknown state occurs, the control unit 1*a* executes the recovery process described below.

Figure 12:
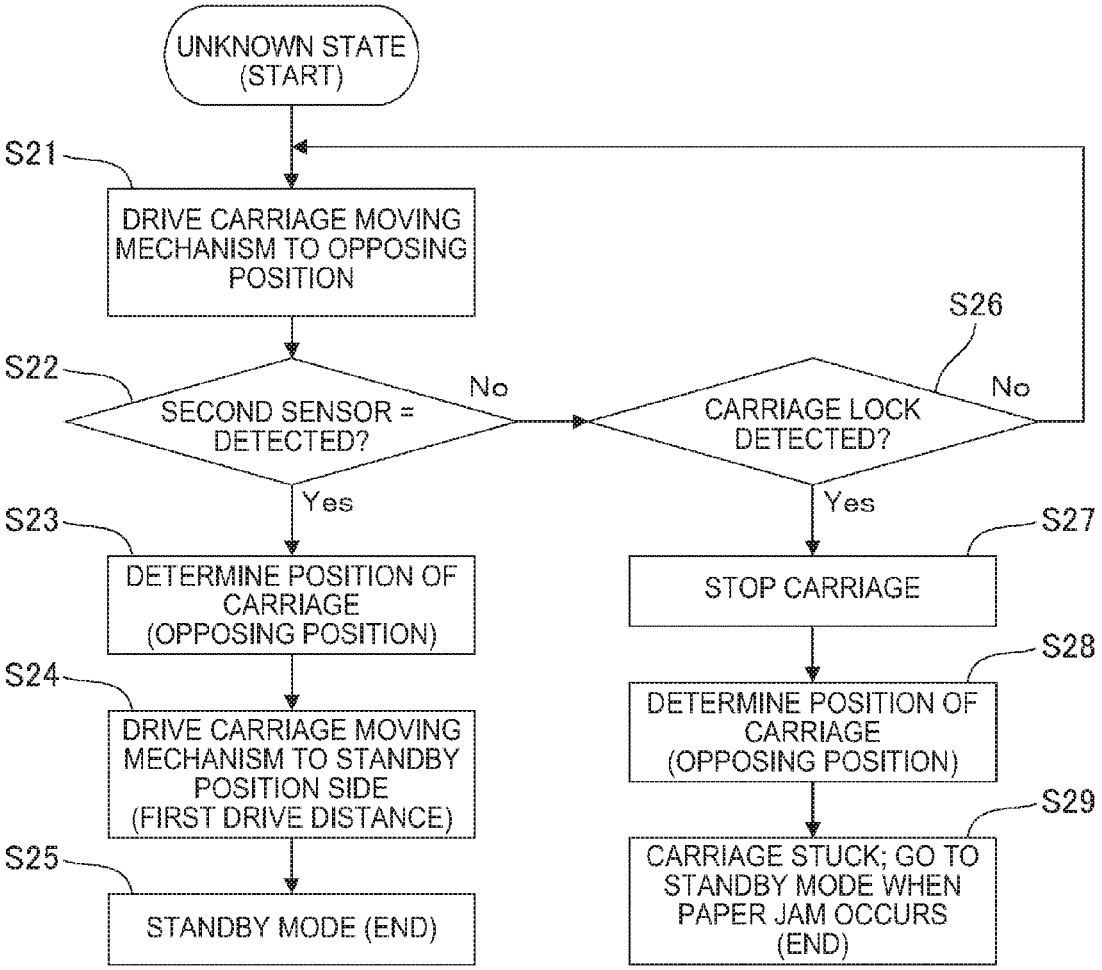
FIG. 12 is a flow chart of the recovery process from an unknown state.

FIG. 12 is a flow chart of the process of recovering from an unknown state. When in the unknown state, the control unit 1*a* drives the carriage moving mechanism 15 to the opposing position 11A side (step S21). The control unit 1*a* then reads the detection signal from the second sensor 19 (step S22). If the second sensor 19 signal indicates Detected (step S22 returns YES), the position of the carriage 11 is determined to be at the opposing position 11A (step S23). The control unit 1*a* then drives the carriage motor 15*a* the first drive distance to the standby position 11B side, returns the carriage 11 to the standby position 11B (step S24), and then goes to the standby mode (step S25).

When the carriage moving mechanism 15 is driven to the opposing position 11A side and the Detected signal from the second sensor 19 is not detected (step S22 returns NO), the control unit 1*a* checks for loss of synchronization of the carriage moving mechanism 15 based on the encoder 15*b* signal and checks if the carriage is locked (step S26). As shown in FIG. 4 and FIG. 10, a side frame 2*b* that supports the internal mechanism of the printer 1 is disposed on the outside side of the opposing position 11A on the transverse axis X. When the carriage 11 is at the opposing position 11A, the side frame 2*b* contacts the side wall portion 49 of the carriage frame 13 where the second guide channel 47*b* is formed (see FIG. 4). More specifically, the side frame 2*b* is a position limiting member that limits movement of the carriage 11 at the opposing position 11A. Therefore, if the signal from the second sensor 19 does not change to Detected and movement of the carriage 11 toward the opposing position 11A continues, the carriage 11 becomes locked against the side frame 2*b*.

If this locked state is detected without the second sensor 19 signal going to the Detected state (step S26 returns YES), the control unit 1*a* stops the carriage 11 (step S27). The control unit 1*a* also determines the carriage 11 is at the opposing position 11A (step S28). As a result, the unknown state is resolved. Based on detecting the locked state, the control unit 1*a* also determines the carriage 11 is stuck and sets the printer 1 to the standby mode assumed when a paper jam error occurs (step S29). A paper jam error is an error that requires correction by the user. However, if the second sensor 19 outputs the Detected signal but a locked state is not detected (step S26 returns NO), control returns to step S21.

If in this embodiment the carriage 11 is moved in an unknown state to the standby position 11B instead of the opposing position 11A and the head frame 12 is not at the up position 12A, the printhead 7 may interfere with the platen top unit 20 and get damaged. When moving to the opposing position 11A side, interference between the printhead 7 and the platen top unit 20 will not occur whether the head frame 12 is in the up position 12A or the down position 12B. The unknown state can therefore be resolved without damage to the printhead 7 or soiling with ink resulting from contact with the printhead 7, for example.

Main Effect of the Invention

As described above, a printer 1 according to this embodiment has a head moving mechanism 17 and a carriage moving mechanism 15 that move the printhead in two directions (the direction increasing or decreasing the platen gap G, and the direction between a position opposite and a position not opposite the platen unit 8), and has a first sensor 18 and a second sensor 19 disposed to detect the printhead 7 or the carriage 11 at reference detection positions (the standby position 11B and the first head position 7A) in each of the two directions.

By thus disposing a sensor in each direction of movement, the current position can be determined based on the amount of movement from the detection position. Therefore, when moving and controlling the position of the printhead 7 in the two directions, there is no need to provide an encoder or other sensor on the head unit to detect the position of the printhead 7 throughout the full range of movement. Increasing the size and complicating the construction of the head unit can therefore be avoided, and increased cost can be avoided.

The detection position of at least one of the first sensor 18 and second sensor 19 is also set to the position of change between movement by the head moving mechanism 17 and movement by the carriage moving mechanism 15. The detection position of the second sensor 19 is set this way in the printer 1 according to this embodiment, but the detection position of the first sensor 18 may be set in the same way. When thus comprised, the printhead 7 or the carriage 11 can always be detected at the position where the direction of movement changes. Therefore, while using a simple sensor, an inappropriate recovery operation based on the sensor output signals can be prevented when the positions of the printhead 7 and the carriage 11 are unclear (unknown) due to an error. More specifically, because the printhead 7 moves in this embodiment when the carriage 11 is at the opposing position 11A, operation of the head moving mechanism 17 can be determined to be inappropriate when the printhead 7 or the carriage 11 is not detected. Furthermore, when the printhead 7 is not detected, damage to the printhead 7 or soiling with ink may occur depending on the direction the carriage 11 moves. Therefore, by moving the carriage 11 in the appropriate direction, the printhead 7 can be recovered from the unknown state without damage to the printhead 7 or soiling with ink.

Furthermore, the first sensor 18 is an optical sensor and the second sensor 19 is a mechanical sensor in this embodiment of the invention, but the size of the head unit is not increased because such sensors are small and simple. Problems resulting from using a large head unit can also be avoided. Installation in limited space is therefore simple, and cost is low.

The head moving mechanism 17 and carriage moving mechanism 15 each comprise a motor as the drive source and an encoder, and can therefore detect if the printhead 7 or the carriage 11 is locked (a state in which the printhead 7 or carriage 11 does not move even though the motor is driven). More specifically, a locked state can be detected by detecting a loss of synchronization between the signals that drive the motors and the signals from the encoders. This locked state occurs when the printhead 7 or the carriage 11 reaches a position jammed against another member in the printer.

The current position of the printhead 7 or carriage 11 can therefore be determined by detecting a locked state. The locked state can therefore be resolved. An error can also be detected based on a loss of synchronization between the signals output from the first sensor 18 or second sensor 19 and the amount the respective motor is driven. Inappropriate operations can therefore be avoided and unknown states can be resolved.

The invention being thus described, it will be obvious that it may be varied in many ways. Such variations are not to be regarded as a departure from the spirit and scope of the invention, and all such modifications as would be obvious to one skilled in the art are intended to be included within the scope of the following claims.

What is claimed is:

1. A printer comprising:

a printhead;

a platen;

a carriage that supports the printhead;

a carriage moving mechanism configured to move the carriage between an opposing position at which the printhead faces the platen and a standby position at which the printhead does not face the platen;

a head moving mechanism configured to move the printhead between a first head position and a second head position, a first gap between the printhead and the platen when the printhead is at the first head position being smaller than a second gap between the printhead and the platen when the printhead is at the second head position; and a sensor configured to detect whether the carriage is at the opposing position and the printhead is at the second head position, or not.

2. The printer of claim 1, wherein the sensor is disposed at a position corresponding to the opposing position.

3. The printer of claim 1, further comprising:

a controller configured to receive a signal from the sensor and drive the carriage moving mechanism and the head moving mechanism based on the signal, wherein;

the sensor outputs a first signal indicating that the carriage is at the opposing position and the printhead is at the second head position, and the controller is configured to:

drive the head moving mechanism to move the printhead toward the first head position, if the controller receives the first signal when driving the carriage moving mechanism, and drive the carriage moving mechanism to move the carriage toward the standby position, if the controller receives the first signal when driving the head moving mechanism.

4. The printer of claim 3, further comprising:

another sensor configured to detect the carriage if the carriage is at the standby position, wherein the controller is configured to:

drive the carriage moving mechanism to move the carriage if the another sensor detects the carriage.

5. The printer of claim 1, further comprising:

another sensor configured to detect the carriage if the carriage is at the standby position; and a controller configured to receive a first signal from the sensor and drive the head moving mechanism, and configured to receive a second signal from the another sensor and drive the carriage moving mechanism, wherein the controller is configured to:

determine that the carriage is at the opposing position if the controller receives the first signal from the sensor; and determine that the carriage is at the standby position if the controller receives the second signal from the another sensor.

6. The printer of claim 5, wherein the carriage moving mechanism comprises:

a carriage motor configured to rotate; and an encoder configured to detect rotation of the carriage motor;

wherein the controller is further configured to:

determine whether the carriage is in a lock state and, if so, stop moving the carriage, if the controller does not receive the first signal from the sensor and receives a signal from the encoder.

7. The printer of claim 5, wherein the controller is further configured to:

determine that the carriage is in an error state if the controller does not receive the first signal from the sensor and the second signal from the another sensor.

8. The printer of claim 7, wherein the controller is further configured to:

drive the carriage moving mechanism to move the carriage to the opposing position after it is determined that the carriage is in the error state.

9. The printer of claim 5, wherein the controller is further configured to:

drive the carriage moving mechanism to move the carriage from the standby position to the opposing position; and drive the head moving mechanism to move the printhead in a descending direction if the controller determines that the carriage is at the opposing position, after the carriage moving mechanism was driven.

10. The printer of claim 5, wherein the controller is further configured to:

drive the head moving mechanism to move the printhead in a descending direction if the controller determines that the carriage is at the opposing position, after the carriage moving mechanism was driven; and determine that the carriage is in an error state if the controller receives the first signal from the sensor and does not receive the second signal from the another sensor after the head moving mechanism was driven.

11. The printer of claim 5, wherein the controller is further configured to:

drive the head moving mechanism to move the printhead in a descending direction if the controller determines that the carriage is at the opposing position;

drive the head moving mechanism to move the printhead in an ascending direction if the controller determines that the carriage is at the opposing position, after printhead was moved in descending direction; and determine that the carriage is in an error state if the controller does not receive the first signal from the sensor and does not receive the second signal from the another sensor after the head moving mechanism was driven.

12. A control method of a printer comprising:

moving a carriage of the printer between an opposing position and a standby position, the opposing position being at which a printhead of the printer faces a platen of the printer and the standby position being at which the printhead does not face the platen;

moving the printhead between a first head position and a second head position, a first gap between the printhead and the platen when the printhead is at the first head position being smaller than a second gap between the printhead and the platen when the printhead is at the second head position; and detecting whether the carriage is at the opposing position and the printhead is at the second head position, or not, based on a signal output by a sensor of the printer.

* * * * *